United States Patent [19]

Roca-Nierga

[11] Patent Number: 4,489,694

[45] Date of Patent: Dec. 25, 1984

[54] MODULAR FUEL INJECTION PUMPS FOR INTERNAL COMBUSTION ENGINES

[75] Inventor: Manuel Roca-Nierga, Barcelona, Spain

[73] Assignee: SPICA S.p.A., Leghorn, Italy

[21] Appl. No.: 384,489

[22] Filed: Jun. 3, 1982

[30] Foreign Application Priority Data

Jun. 11, 1981 [DE] Fed. Rep. of Germany ..... 3123095

[51] Int. Cl.[3] ..... F02M 63/02

[52] U.S. Cl. ..... 123/449; 123/198 F

[58] Field of Search ..... 123/198 F, 449, 503

[56] References Cited

U.S. PATENT DOCUMENTS

| | | | |
|---|---|---|---|
| 3,741,685 | 6/1973 | Simko | 123/198 F |
| 3,815,563 | 6/1974 | Stinsa | 123/198 F |
| 3,896,779 | 7/1975 | Omori et al. | 123/198 F |
| 3,902,472 | 9/1975 | Baugezin | 123/198 F |
| 3,929,113 | 12/1975 | Kawase et al. | 123/198 F |
| 3,974,810 | 8/1976 | Yajima | 123/198 F |
| 4,150,651 | 4/1979 | Wade et al. | 123/198 F |
| 4,413,600 | 11/1983 | Yanagawa et al. | 123/198 F |

*Primary Examiner*—Ira S. Lazarus

*Attorney, Agent, or Firm*—Diller, Ramik & Wight

[57] ABSTRACT

This invention relates to an injection pump (11) for internal combustion engines equipped with members (19, 21) for selectively cutting off the fuel delivery (15) to a preselected and variable number of cylinders in a plural-cylinder engine, when the power required of the engine is but a fraction of the power the engine can deliver, so as to obtain conditions of minimum specific consumption of fuel.

6 Claims, 7 Drawing Figures

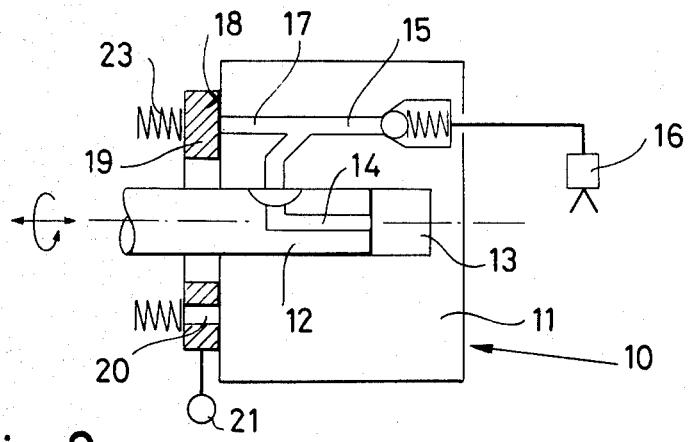
Fig. 1
Fig. 2
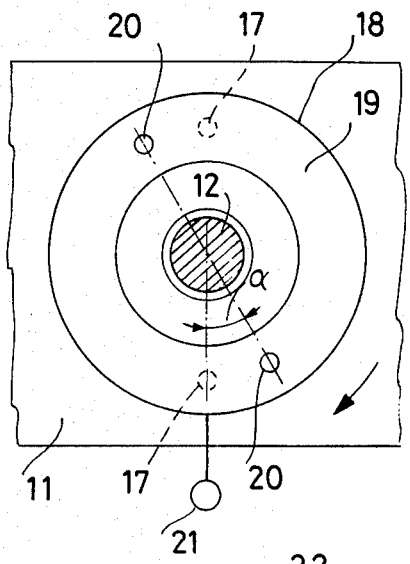
Fig. 3
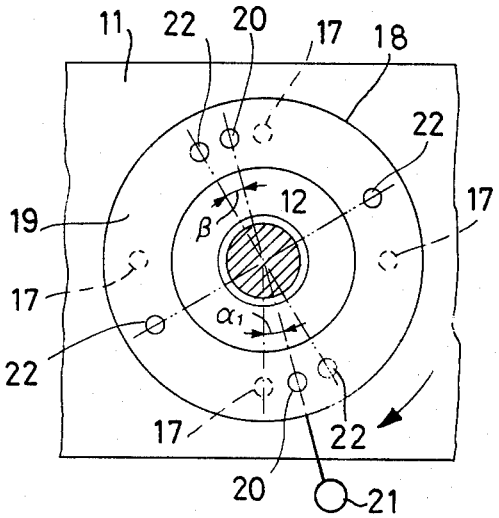
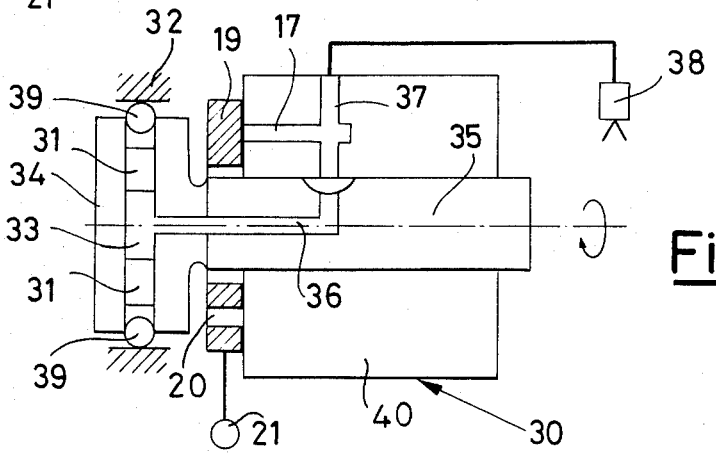
Fig. 4

MODULAR FUEL INJECTION PUMPS FOR INTERNAL COMBUSTION ENGINES

It is known that the efficiency of an internal combustion engine is a function, and in a determining manner, of the power required of the engine. As a matter of fact, there is an optimum value of the efficiency which very considerably decreases when the delivered power goes far from the power at which the specific consumption is at a minimum.

To prevent such a shortcoming, it would be desirable, in plural-cylinder engines and for low delivered powers, to obtain that the engine may work by feeding only some of the cylinders, so that the required power is allotted among the cylinders which remain in action so that the individual cylinders are subjected to a load corresponding to a lower specific fuel consumption.

Such an expedient is the more useful the more cylinders there are in an engine, because the number of the active cylinders can be proportionally reduced as the power to be delivered by the engine concerned is varied.

The prior art has suggested a number of approaches but none of them can be assessed as being functionally or economically acceptable. A few versions (DE-PS No. 304142, DE-OS No. 2001217 and GB Pat. No.-1352148, particularly FIG. 5) provide, in fact, the use of cylindrical valve means which, in order to provide a tight seal when subjected to the pressures of hundreds of bars which are experienced in the injection systems, must provide very reduced diametrical clearances (in the order of magnitude of 2 to 3 microns) and are thus expensive as to their manufacture. Such cylindrical valve means, moreover, do not permit the automatic backlash takeup to balance the wear occurring in use on the sealing surfaces.

Other known approaches (GB Pat. No. 1352148, FIGS. 1, 2, 3, 4 and GB Pat. No. 2038934A) have adopted intricate mechanisms for varying the length of coupling between two sections of the control rods connected to the several pumping members of the injection system. The sliding coupling of the two sections of the control rod is obtained by telescopable means. By varying the length of such coupling, the functional cutoff of the engine cylinders fed by the pumping members connected to either rod section is achieved without involving the remaining cylinders. These approaches, however, in addition to being mechanically clumsy, can be applied only to injection systems of the so-called "in line" type and, moreover, they do not permit to select, in operation, the number of the cylinders to be excluded as a function of the working conditions of the engine.

Yet a further known approach (AT 111 446) suggest the adoption of poppet valves which can be actuated either mechanically or electrically, shunt connected to the high pressure duct of the injection pump. Such valves show a tendency of losing their sealtightness in use so that they may originate drops of delivery in the correspondingly connected members.

It is required, in addition, to provide as many valve units as there are cylinders of the engine to be connected to exhaust.

It should also be noted that many of the cutoff devices referred to above are discrete units relative to the injection system and this facilitates their optionally use but considerably increases the weight of the composite system structure.

This invention, therefore, has for its object to provide a simple and cheap system for connecting to discharge one or more delivery conduits of an injection pump, irrespective of the fact that the pump is of the "in line" type or of the distributor type, so as to obtain the functional cutoff of the corresponding engine cylinder.

As compared with the conventional systems, the present invention affords the following advantages:

(a) Planar sealing surfaces, and thus ease of manufacture and cheapness, (b) Contact ensured by resilient or hydraulic means and thus any wear clearance can be taken up, (c) Possibility of selecting, in operation, the number of delivery conduits to be connected to discharge as a function of the working conditions of the engine, (d) Cutoff device inserted in the interior of the injection pump as such, (e) No intricate controls.

(f) A single sealing member irrespective of the number of delivery conduits to be connected to discharge.

(g) Applicability to any injection pump.

These objectives are achieved, according to the invention, by providing an injection pump comprising a pumping unit to which there are associated a number of delivery conduits, each opening into an injector which feeds fuel to a cylinder of a plural-cylinder engine, characterized in that one or more of said conduits has, associated therewith, a sliding valve means with planar sealing member, equipped with one or more openings and with resilient or hydraulic biassing means adapted to ensure the continuous contact with a cooperating surface, also planar, on which said valve means is displaced and into which one or more passageways open which are connected to said delivery conduits, said sliding valve means being capable of occupying a plurality of positions to close or, as an alternative, to connect to discharge at least one of said, one or more passageways, each position of said plurality of position corresponding to a different number of conduits or to different cnduits connected to discharge for suppressing the delivery sent to the corresponding injector.

The invention will be more clearly explained in connection with the ensuing description of a few exemplary embodiments shown in the accompanying drawings, wherein:

FIG. 1 diagrammatically shows an injection pump embodying the invention,

FIGS. 2 and 3 are views of details of the pump of FIG. 1,

FIGS. 4 and 5 are views akin to that of FIG. 1 and are concerned with injection pumps of various kinds.

Figure 5:
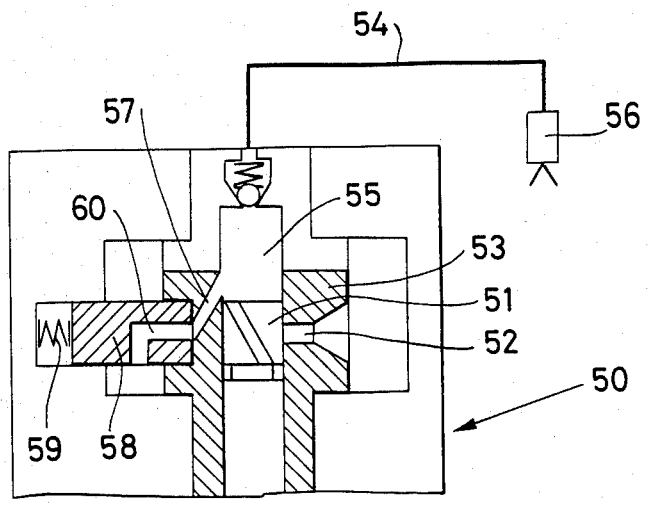

Having reference to FIG. 1, an injection pump, generally indicated at 10, comprises a casing 11, in which a piston 12 is movable, which is both rotated and reciprocated. The reciprocal motion of the piston brings about a pumping action into the chamber 13, so that the fuel is conveyed to a conduit 14 opening radially with respect to the piston in correspondence with a delivery duct 15 which feeds an injector 16. Radially with respect to the piston, as many conduits 15 are arranged as there are cylinders in the engine, and the fuel is selectively delivered to each of them by effect of the rotation of the piston, so that the latter is also a distributing member.

Such an injection pump is well known as such to those skilled in the art, so that its structure has merely been mentioned just to define the type.

According to the invention, and quite characteristically, from one or more of the delivery conduits 15 a passage 17 is branched off, which opens in correspondence with a planar surface 18 of the pump casing 11: against 18 pressurally rests a ring 19 to cut off the passages 17, said ring being biassed by springs 23 or by hydraulic means.

FIG. 2 illustrates in more detail in side elevational view the function of the ring 19 in the case of an injection pump having four delivery ways. The ring 19 has two bores 20 formed therethrough, which are arranged diametrically opposite to one another so as to be enabled to come into registry with the two passageways 17 which extend two likewise diametrically opposite conduits 15.

The drawing shows the ring 19 in such a position that it closes such passageways 17 so that the pump 10 operates in its usual manner.

If, by the instrumentality of a control 21, the ring 19 is rotated clockwise through an angle alpha, the two bores 20 come into registry with the couple of passageways 17 so that the relative two conduits 15 are permanently connected to the discharge, and the delivery of the respective nozzles 16 is nil. Thus, under such conditions, the 4-cylinder engine to which the pump is attached works with two active cylinders only, so that the power at which the best combustion efficiency is achieved, and thus the minimum specific fuel consumption, is halved relative to the nominal engine power.

FIG. 3 shows, similarly to what has been shown in FIG. 2, how a regulation can be made in the case of a pump of injection having eight delivery conduits, thus a pump to be mounted on an 8-cylinder engine.

The ring 19 has been shown in its position where it masks all the passageway 17 which, in the case in point, are four and are angularly shifted through 90° relative to each other.

In the ring 19 there have been shown two as formed bores 20 diametrically opposite with respect to one another and shifted through an angle $\alpha_1$, relatively to two passages 17, and four additional bores 22, shifted through $\alpha_1+\beta$ relative to the four passages 17.

Thus, by rotating through an angle $\alpha_1$ the ring 19 clockwise, two cylinders are deactivated and the engine runs with six active cylinders, thus at $\frac{3}{4}$ of its total swept volume. If the ring 19 is now rotated through an additional angle $\beta$, four cylinders are deactuated and the engine will thus be shared among the remaining four ones.

The principles of the invention can likewise be applied to other kinds of pumps, known as themselves, but different from the distributor piston type shown in FIG. 1.

For example, in FIG. 4 another known kind of injection pump, 30, is shown, having radial pistons 31 driven by spheres 39 which roll on a cammed race 32 to pump fuel into a chamber 33 formed in the rotor 34: the latter with its portion 35, acts as a distributor by bringing the conduit 36 in registry with more delivery conduits 37 formed through the casing 40, each conduit being ended at an injector 38.

One or more delivery conduits 37 have passages indicated at 17 because they are functionally entirely akin to those passages 17 which were shown in the pump 10 of FIG. 1. Said passages 17 coact with a ring 19 of the kind already described above and best seen in FIGS. 2 and 3 by way of example only.

Injection pumps are also in current use, which do not use a pumping unit and a distributor for the several injectors associated to the engine cylinders, but, rather, an individual pumping system for each injector. Also these pumps may have the principles of the invention applied thereto.

FIG. 5 is a cross-sectional view through a pumping unit of an injection pump with many cylinders, generally indicated at 50.

This kind of a pump, as is known to those skilled in the art, generally comprises a plurality of pistons 51, which are reciprocable and which can meter their volumetric delivery by being rotated about themselves so as to vary the unmasking phase of the ports 52 which are formed radially through the cylinder 53 for induction and discharge.

Delivery takes place through a duct 54 which connects the pumping chamber 55 to the injector 56.

According to the invention, from the chamber 55 of one or more pumping units, a conduit 57 is branched off which can be selectively set to discharge by a sliding valve 58 biassed by springs 59 or by hydraulic movers and in which one or more passages are formed, 60, which are adapted to connect to discharge the conduits 57 with which they are in registry.

In practice, the sliding valve 58 may be merely considered as a rectilinear extension of the ring 19 shown in FIGS. 1 to 4.

Figure 6:
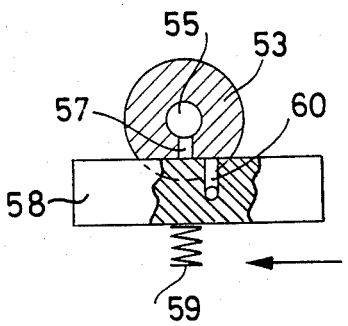
FIGS. 6 and 7 are detail views of the pump shown in FIG. 5.

FIG. 6 is a diagrammatical cross-sectional view of a unitary sliding valve 58 in the closed position, in which the pump works in the current way.

It is apparent that one leftward stroke of the sliding valve 58 sets the conduit 60 in registry with the relative unit and puts the latter permanently connected to discharge so that the delivery of fuel to the corresponding injector is cut off.

Figure 7:
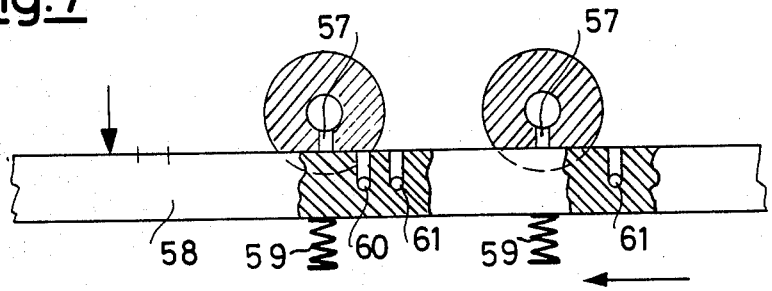

In FIG. 7, the valve is shown with a structure similar to that of the ring 19 shown in FIG. 3.

As a matter of fact, in addition to a number of bores 60, one of which has been shown, also a second set off bores 61, has been formed. A first stroke of the valve thus places one or more bores 60 in registry with passageways 57. A further stroke, instead, puts a different number of bores 61 in registry with the passages 57 so that a different number of pumping units are excluded and thus a different number of cylinders fed by the pumping system do not receive fuel injection.

The embodiments described hereinabove and diagrammatically shown in the drawings by way of example can be varied of course in a number of ways also on taking into account the structure of the particular pump to which the invention is to be applied.

Also the combination of the conduits to be connected to discharge is differently variable also as a function of the number of cylinders which are in the engine to which the pump is associated.

Thus an 8-cylinder engine may provide delivery cut-off for two or four cylinders, to work with six or four cylinders, respectively.

A 5-cylinder engine may be switched to work with three cylinders and, optionally, with two cylinders only.

In a similar way, a 4-cylinder engine may be preset for working with three cylinders or two cylinders only.

The provided for plurality of positions of the valve means or member can also serve to alternate the engine cylinders left operative, also with their number being equal, so as to render uniform the resulting wear of all the cylinders of the internal combustion engine.

I claim:

1. An injection pump for internal-combustion engines comprising a pumping unit to which a plurality of delivery conduits are associated, each feeding an injector to feed fuel to a cylinder or a plural-cylinder engine, characterized in that one or more of said conduits are associated to a valve means which slides with a planar sealing member (19, 58) having one or more openings (20, 22, 60, 61) and resilient (23, 59) or hydraulic biasing means, adapted to ensure a continuous contact with a coacting equally planar surface (18) whereon said valve means is movable and into which open one or more passageways (17, 57) connected to said delivery conduits, said slidable valve member (19, 58) being capable of taking a plurality of positions for obstructing or, as an alternative, connecting to discharge at least one of said one or more passageways (17, 57) and each position of said plurality of positions corresponding to a different number of conduits or to different conduits connected to discharge to suppress the delivery sent to the corresponding injector.

2. An injection pump according to claim 1, characterized in that said pump is of the type in which a pumping unit (12) is connected via a distributor (14) to a plurality of delivery conduits (15) which feed respective injectors (16), from one or more of said conduits passages (17) being branched off which open on a planar surface (18) in correspondence with a circular area on which an annular member (19) is rotated through which one or more bores (20) are formed which selectively put themselves in registry with at least one of said one or more passageways (17) to connect the latter to discharge.

3. An injection pump according to claim 1, characterized in that said pump is of the kind in which a pumping and distributing unit (34, 35) is connected to a plurality of delivery conduits (37) which feed respective injectors (38), from one or more of said conduits (37) passages (17) being branched off which open on a planar surface (18) in correspondence with a circular area whereon an annular member (19) is rotated through which one or more bores (20) are formed which are arranged selectively in registry with at least one of said one or more passages (17) to connect the latter to discharge.

4. An injection pump according to claim 1, characterized in that said pump is of the kind comprising a plurality of pumping units (51) each feeding an individual injector (56), the pumping chamber (55) of one or more of said units being equipped with a branched off passageway (57), said one or more passageways (57) opening in correspondence with a movable member (58) having a planar surface on which one or more bores (60, 61) are formed which can be selectively placed in registry with at least one of said one or more passages to connect the latter to discharge.

5. An injection pump for internal-cumbustion engines comprising a pumping unit including a housing, a plurality of delivery conduits in said housing, each effective to deliver fuel to an associated engine cylinder, piston means for selectively delivering fuel to said plurality of delivery conduits, each delivery conduit being in fluid communication with a conduit portion in said housing and opening outwardly of said housing for selectively bleeding said delivery conduits and preventing fuel delivery to associated cylinders, each conduit portion opening through a planar face of said housing, slidable valve means for cooperating with each planar face and associated conduit portion for selectively respectively closing and opening communication relative to said conduit portions, and said slidable valve means defining a planar seal with each said planar faces for selectively closing communication relative to said conduit portions.

6. The injection pump as defined in claim 5 wherein fuel flows through said conduit portions in a predetermined direction, and resilient or hydraulic biasing means acting against said slidable valve means in a direction opposite to said first-mentioned direction to maintain said planar faces in sealed relationship.

* * * * *